United States Patent [19]

Schindler et al.

[11] 4,373,474

[45] Feb. 15, 1983

[54] SCAVENGING ARRANGEMENT FOR A TWO-STROKE INTERNAL COMBUSTION PISTON ENGINE

[75] Inventors: Manfred Schindler, Markt Schwaben; Reinhold Ficht, Kirchseeon; Hermann Vogt, Fürmoosen, all of Fed. Rep. of Germany

[73] Assignee: Ficht GmbH, Kirchseeon, Fed. Rep. of Germany

[21] Appl. No.: 221,196

[22] Filed: Dec. 29, 1980

[30] Foreign Application Priority Data

Nov. 4, 1980 [DE] Fed. Rep. of Germany ..... 3041560

[51] Int. Cl.[3] ..... F02B 75/24

[52] U.S. Cl. ..... 123/56 B; 123/56 C; 123/65 P; 123/65 PD; 123/74 R; 123/73 PP

[58] Field of Search ..... 123/56 C, 56 BC, 65 PD, 123/65 P, 65 PE, 65 A, 74 R, 74 A, 73 PP

[56] References Cited

U.S. PATENT DOCUMENTS

| | | | |
|---|---|---|---|
| 3,059,626 | 10/1962 | Froehlich et al. | 123/65 A |
| 3,204,619 | 9/1965 | Rubinowitz et al. | 123/74 A |
| 3,311,095 | 3/1967 | Hittell | 123/56 C |
| 3,946,706 | 3/1976 | Pailler | 123/56 BC |

FOREIGN PATENT DOCUMENTS

| | | | |
|---|---|---|---|
| 918521 | 1/1973 | Canada | 123/56 BC |
| 409919 | 2/1925 | Fed. Rep. of Germany . | |
| 706029 | 5/1941 | Fed. Rep. of Germany . | |
| 595404 | 7/1925 | France | 123/56 BC |

*Primary Examiner*—Wendell E. Burns

*Attorney, Agent, or Firm*—Toren, McGeady and Stanger

[57] ABSTRACT

In a two-stroke internal combustion piston engine, a piston is reciprocally movable within an axially elongated cylinder. The piston has a bottom dead center position and in the region of this position, the cylinder has an exhaust opening and a number of pairs of scavenging openings. An axially extending plane within the cylinder divides the exhaust opening in half and in each pair the scavenging openings are arranged symmetrically on opposite sides of the axially extending plane. Each pair of scavenging openings is located at a different distance from the exhaust opening. The projection of the side surfaces of the pairs of scavenging openings extending in the axial direction of the cylinder each form a different angle at the point of intersection of the projections and the point of intersection is directed away from the exhaust opening. The projection of the side surfaces of the pairs of scavenging openings extending transversely of the axial direction form different angles with a plane extending perpendicularly of the axial direction of the cylinder.

7 Claims, 10 Drawing Figures

SCAVENGING ARRANGEMENT FOR A TWO-STROKE INTERNAL COMBUSTION PISTON ENGINE

SUMMARY OF THE INVENTION

The present invention is directed to a two-stroke internal combustion piston engine with an arrangement for scavenging the piston cylinders. Within the cylinder the piston has dead-center positions and scavenging openings are located in the cylinder wall in the region of the bottom dead center position. The scavenging air or scavenging mixture is directed through scavenging ducts and the scavenging openings into the cylinder for expelling the hot residual gases from the preceding working stroke. The side surfaces of the scavenging openings are arranged so that the individual scavenging flows through the openings combine and flow upwardly toward the cylinder head and then reverse direction and flow downwardly to an exhaust window, located in the cylinder adjacent to the bottom dead center position, for expelling the hot residual gases.

In the development of two-stroke internal combustion piston engines, the rapid and complete expulsion from the working cylinder, to the extent possible, of the hot residual gases of the preceding working stroke has played a substantial role. The degree of removal of the residual gas especially determines engine efficiency and specific power. Remaining hot residual gases reduce the amount of fuel which can be admitted to the working cylinder. To scavenge hot residual gases from the working cylinder after a working stroke, a number of methods and arrangements have been employed. In providing a scavenging effect, individual scavenging openings have been provided over half of the circumference of the cylinder in the region of the bottom dead center position of the piston within the cylinder. These scavenging openings have been located opposite exhaust openings so that, after pre-exhaust, scavenging air is blown radially into the working cylinder (see page 21, FIG. 28 of the book "Bau und Berechnung der Verbrennungskraftmaschinen"—Construction and Design of Internal Combustion Engines—by Otto Kraemer, 3rd Edition, 1948, Springer-Verlag). This arrangement of the scavenging windows, however, extending over half of the circumference of the working cylinder is not sufficient to achieve a complete removal of the hot residual gas, since the arrangement of the scavenging openings leads to turbulence during the scavenging operation. This disadvantage is at least partially avoided by an arrangement of symmetrically arranged scavenging ducts and scavenging openings directed obliquely toward the inner surface of the cylinder and located opposite the exhaust openings, so that the scavenging air or scavenging mixture flows upwardly along the inner surface of the cylinder and cleans out the cylinder volume while affording reduced turbulence (see page 141, FIG. 2 of the book "Taschenbuch für den Maschinenbau"—Manual for Mechanical Engineering—by Professor Heinrich Dubbel, Second Volume 1943, Springer-Verlag). Such an arrangement, however, also has deficiencies because the scavenging curtain developed does not have an ideal geometric shape for the scavenging operation, since it is developed in the cylinder in too short a time and is too compact, whereby residual gases are frequently divided with residual gas pockets remaining within the cylinder.

The primary object of the present invention is to provide a two-stroke internal combustion piston engine with an arrangement of scavenging ducts and scavenging openings which, in consideration of the scavenging time based on the engine type or the mechanics of the crank assembly, afford optimum scavenging conditions which achieve a maximum degree of scavenging and, thus, a higher yield or efficiency.

In accordance with the present invention, in a two stroke internal combustion piston engine of the above-mentioned type, several pairs of symmetrically arranged scavenging channels and scavenging openings are provided through the cylinder wall opposite the exhaust opening with the pairs of openings being arranged one on each of the opposite sides of a plane of symmetry which divides the exhaust opening and which plane extends in the axial direction of the cylinder. The projection of the side surfaces of the scavenging openings extending in the axial direction of the cylinder intersect with the point of intersection directed away from the exhaust opening. Each pair of scavenging openings is located at a different distance from the exhaust opening. The projection of the axially extending side surfaces of the pair of openings most remote from the exhaust opening form an angle larger than the angle of the pairs of openings closer to the exhaust opening. Further, the projection of the side surfaces of the scavenging openings extending transversely of the axial direction of the cylinder form acute angles with a plane extending perpendicularly of the axial direction of the cylinder. The angle formed by the transversely extending side surfaces of the pair of openings most remote from the exhaust opening form a greater angle with a transversely extending plane than the similar angle formed by the transversely extending side surfaces of the pairs of scavenging openings closer to the exhaust opening. This angle is characterized as an elevation angle.

In accordance with the present invention, the projections of the axially extending side surfaces of the pair of scavenging openings most remote from the exhaust opening form an angle of about 160° and the transversely extending side surfaces form an elevation angle of about 25°. The next pair of openings closer to the exhaust opening have the projections of the axially extending side surfaces intersecting at an angle of about 140° and form an elevation angle of about 15°. A third pair of scavenging openings still closer to the exhaust opening have the projections of the axially extending surfaces forming an angle at their intersection of about 110° with the transverse side surfaces forming an elevation angle of about 10°.

By varying the angular introduction of the scavenging medium into the cylinder, a highly dispersed scavenging effect is afforded and, furthermore, a scavenging over a large volume and across the entire cross section of the cylinder is attained and is effective over the entire cylinder volume by rising along the cylinder surface and completely cleaning out the cylinder volume. In the scavenging operation, the residual gas portion located above the piston is swept up and moved along the cylinder surface in an accelerated manner.

Another feature of the invention involves the arrangement of the transversely extending side surfaces of the pair of scavenging openings most remote from the exhaust opening being spaced further from the bottom dead center position of the piston than the corresponding transversely extending side surfaces of the scavenging openings of the other pairs.

Due to the arrangement embodied in the present invention, a pre-acceleration of the residual gases is achieved by means of a portion of the scavenging medium, so that dynamic pressures during the expelling of the residual gases are avoided. Simultaneously, the cooling of the underside of the piston is improved.

By using a crank guide assembly for coupling the oppositely located pistons of the two-stroke engine, in accordance with the present invention, it is possible to provide an advantageous influence on the scavenging time in the top and bottom dead center positions which is especially advantageous in the alternating charging procedure involved.

The arrangement of the crank guide assembly and the disposition of the walls separating the assembly from the cylinders, which walls form bearing hubs provide, in addition to a stiff and robust construction of the engine housing, a bearing which favorably absorbs the dynamic forces generated at the crank guide assembly. As a result, friction forces are reduced, particularly in the crank guide assembly. A bearing for the crank guide frame is unnecessary. This arrangement reduces the structural length of the engine, especially the length of the piston rods. Moreover, the crank guide assembly is hermetically sealed from the interior of the cylinders in which chemically aggressive environments are present, with the result that increased service life of the crank guide assembly is achieved. Finally, the flow paths for the fresh intake charge are advantageous and make high engine speeds possible.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAIL DESCRIPTION OF THE INVENTION

Figure 1:
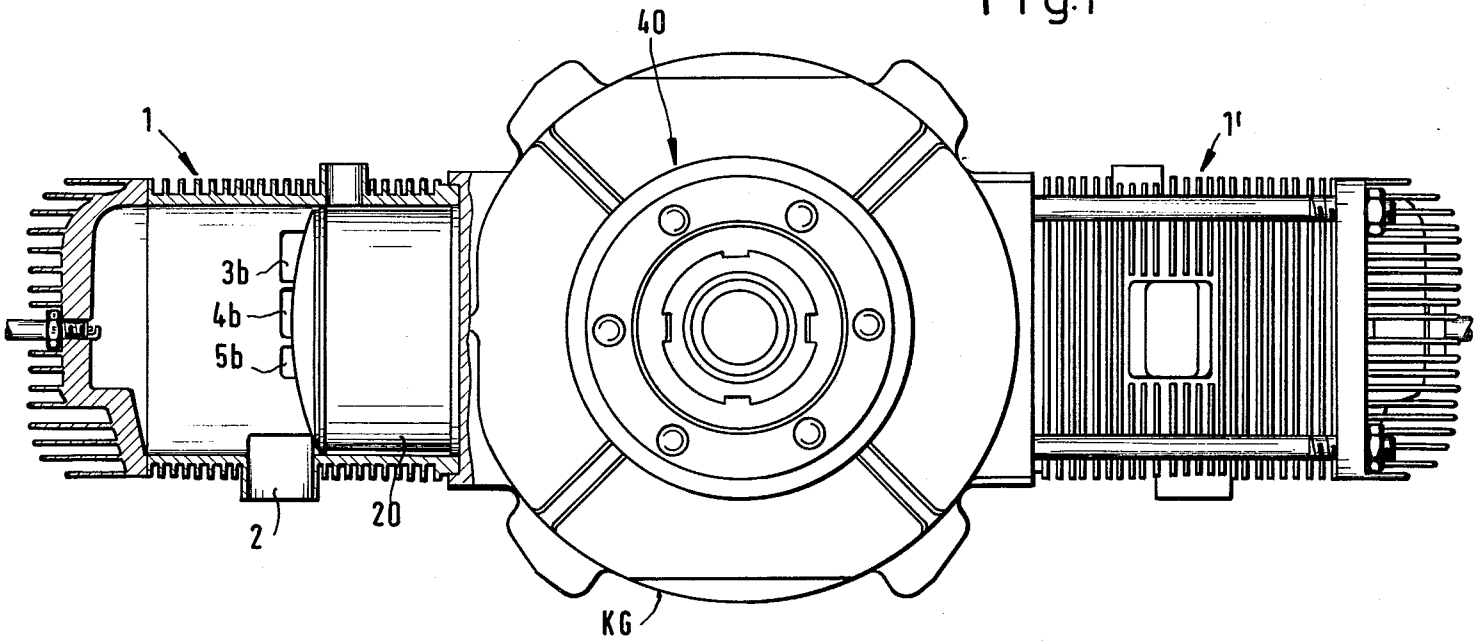
FIG. 1 is a view of a two-cylinder two-stroke internal combustion piston engine embodying the present invention with a portion of the left-hand cylinder cut away revealing the piston.
Figure 2:
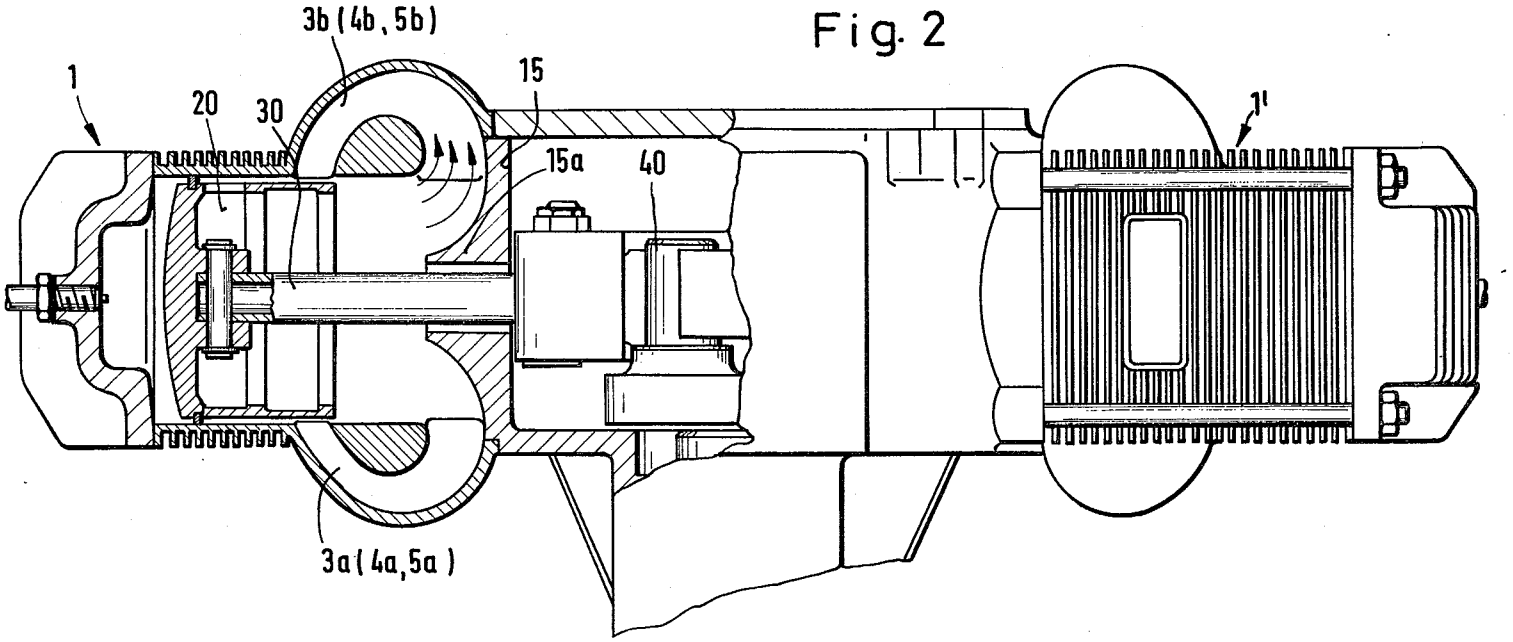
FIG. 2 is another view of the engine shown in FIG. 1 with the left-hand portion shown in section.

The engine illustrated in FIGS. 1 and 2 is constructed in the manner of a so-called opposed cylinder-type engine, and consists essentially of two opposed, coaxially arranged working cylinders 1, 1' with working pistons 20 reciprocating rectilinearly within the cylinders. Each piston 20 is connected to a piston rod 30 with the piston rods reciprocating in a straight line. Each piston rod 30 extends out of the cylinder 1, 1' and is articulated at its end outside the cylinder to a concentric revolving crank guide assembly 40 for converting rectilinear movement to rotary movement. The crank guide assembly 40 is located within a crank guide housing KG with the cylinders 1, 1' fastened to the housing via separating walls 15 which extend transversely of the axial direction of the piston rods 30. The central portion of each separating wall forms a bearing hub 15*a* extending in the axial direction of the piston rods 30 into the associated cylinder 1, 1', note FIG. 2. The bearing hubs 15*a* are generally conically shaped with their surfaces converging in the direction away from the crank guide assembly 40. The conical contour of the bearing hubs 15*a* correspond to the facing surfaces of the pistons 20. The contour of these surfaces is selected in dependence on the number and position of the scavenging ducts 6*a*–8*b*. Further, the openings into the scavenging ducts adjacent the separating walls 15 are flush with the surfaces of the separating walls.

Figure 3:
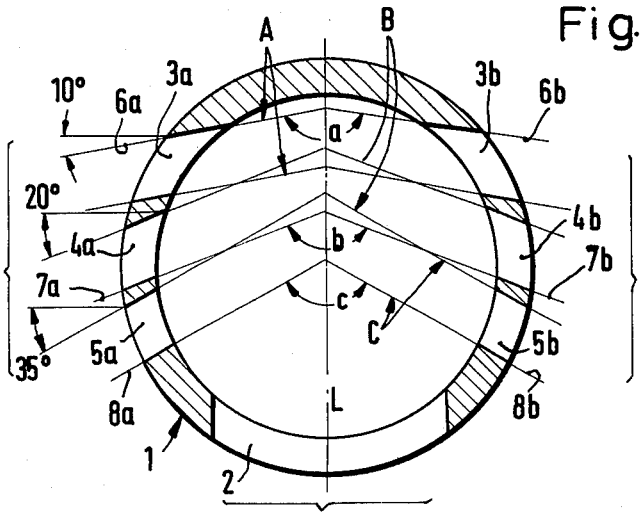
FIG. 3 is a transverse sectional view of one of the cylinders in the engine shown in FIGS. 1 and 2 in the region of the scavenging openings and exhaust openings.
Figure 4:
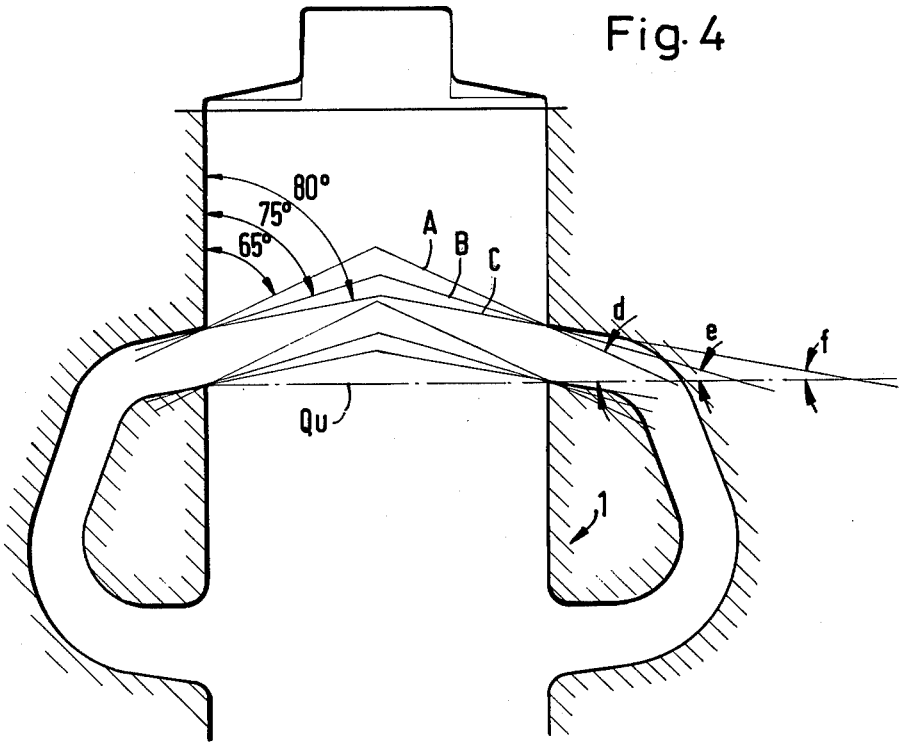
FIG. 4 is an axially extending sectional view of the cylinder shown in FIG. 3.

In the following, the scavenging operation within a cylinder is described with the aid of FIGS. 3 to 7. As the piston 20 reciprocates within the cylinder 1, it reaches a bottom dead center and in the region adjacent this position an exhaust opening 2 is provided in the cylinder 1. In the same region, spaced in the circumferential direction of the cylinder from the exhaust opening 2, there are three pairs of scavenging openings 3*a*, 3*b*; 4*a*, 4*b*; and 5*a*, 5*b*. As shown in FIG. 3, an axially extending plane L extends symmetrically through the exhaust opening 2 and each pair of scavenging openings is arranged symmetrically of the plane, that is, in each pair, the openings are symmetrically located on opposite sides of the plane. The scavenging openings 3*a*–5*b* are supplied via scavenging ducts 6*a*–8*b*, in a conventional manner, with fresh scavenging medium, that is, either scavenging air in the case of a diesel engine or a scavenging mixture in the case of Otto or spark-ignition engines. As viewed in FIG. 3, projections A of the axially extending side surfaces of the scavenging openings, 3*a*, 3*b* extend into the cylinder and intersect in an arrow-like shape with the point of the arrow directed away from the exhaust opening. Further, the angle a formed by the projections A is about 160°. This angle, formed by the projections A for the scavenging openings most remote from the exhaust opening 2, forms a larger angle than formed by the projections B and C extending inwardly from the axially extending side surfaces of the scavenging openings 4*a*, 4*b* and 5*a*, 5*b*. The angle b formed by the projections B is about 140°, and the angle c formed by the projections C is about 110°. As the pairs of scavenging openings symmetrically arranged relative to the plane L approach the exhaust opening 2, the inwardly extending projections of their axially extending side surfaces form angles of decreasing magnitude. Aside from the angles a, b and c formed by the arrow-like shape of the intersections of the projections, the transversely extending side surfaces of the scavenging openings 3*a*–5*b* also form different elevation angles d, e, f with respect to a cross-sectional plane Qu of the cylinder, note FIG. 4. As with the angles formed by the projections of the axially extending side surfaces, so also the projections of the transversely extending side surfaces of the scavenging openings form angles of varying sizes with the elevation angles d formed by the scavenging openings 3*a*, 3*b* most remote from the exhaust opening 2 being larger than the angles formed by the scavenging openings 4a, 4b; 5a, 5b closer to the exhaust opening. Accordingly, the angle between the projections A from the transversely extending side surfaces of the scavenging openings 3a, 3b and the plane Qu form the largest elevation angle d of about 25°, note FIG. 4. The angles shown in FIG. 4 are measured between the projections A, B, C and the axial direction of the cylinder which is the complement of the elevation angles d, e and f. The elevation angle formed by the projections B of the transversely extending side surfaces of the scavenging openings 4a, 4b with the plane Qu is 15°, while the projections C from the transversely extending side surfaces of the scavenging openings 5a, 5b form the smallest elevation angle f with the plane Qu which is about 10°.

Figure 5A:
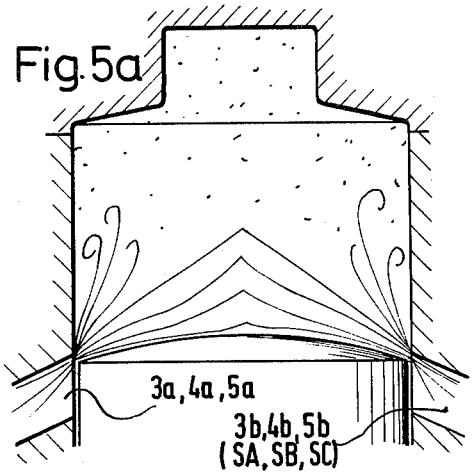
FIGS. 5*a* through 7*b* schematically display the scavenging operation in axially extending sections of the cylinder, with FIGS. 5*b*, 6*b* and 7*b* rotated by 90° relative to FIGS. 5*a*, 6*a* and 7*a*, respectively, for illustrating the scavenging openings in the cylinder.
Figure 5B:
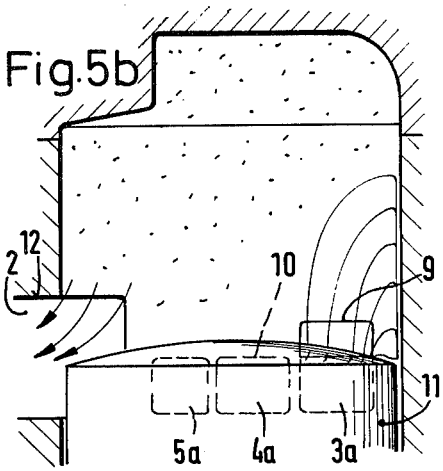
Figure 6A:
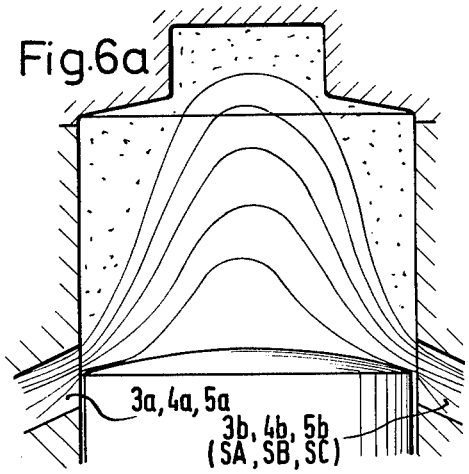
Figure 6B:
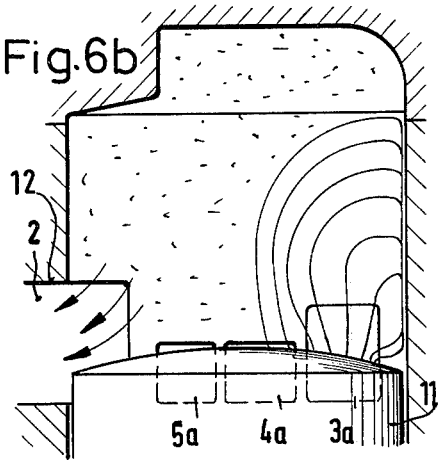
Figure 7A:
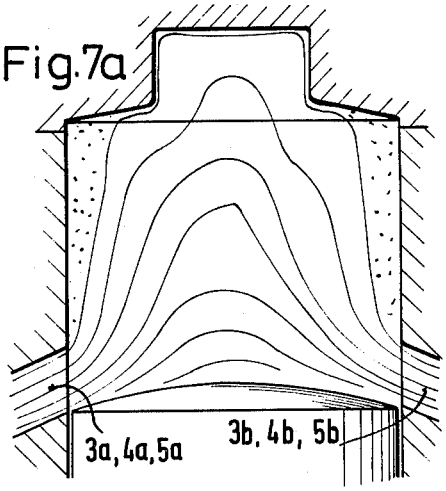
Figure 7B:
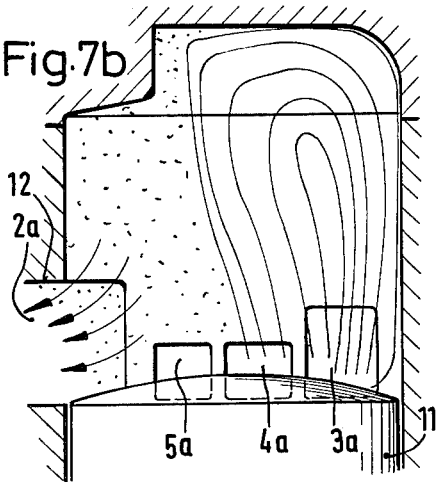

As can be seen in FIG. 5b, the upper transversely extending side surface 9 of the scavenging openings 3a, 3b, that is, the transversely extending side surface more remote from the bottom dead center position of the piston 20, is spaced above the corresponding transversely extending side surfaces of the scavenging openings 4a, 4b, 5a, 5b, that is, further from the bottom dead center position.

In FIGS. 5a to 7b the scavenging flows SA, SB and SC are shown from the scavenging openings 3a to 5b. The flow passes from the scavenging ducts 6a to 8b through the scavenging openings 3a to 5b initially being aligned in the direction of the projections A, B, and C.

The following is a description of the manner in which the scavenging operation proceeds.

As viewed in FIGS. 5a–7b, during the downward stroke of the piston 20 toward the bottom dead center position, initially the upper guiding edge 12 of the exhaust window 2 is passed so that the pre-exhaust is commenced. It can be seen that the guiding edge 12 of the exhaust window 2 is spaced upwardly above the upper transversely extending side surfaces of the scavenging windows 3a–5b. As the piston 20 clears the guiding edge 12 of the exhaust opening 2, the first surge of the hot working gases exit from the interior of the cylinder through the exhaust opening. As the piston 20 continues its downward movement it first passes the upper transversely extending side surface or guiding edge 9 of the scavenging openings 3a, 3b defining the first pair of projections A with the first scavenging flows SA streaming into the cylinder 1. Due to the elevational angle d, note FIG. 4, the flow through the scavenging windows 3a, 3b is relatively steep along the inside surface of the cylinder and, because of the maximum arrow-like shaped angle a, these initial scavenging flows move upwardly with a relatively small forward speed. As a result, the inert mass of the hot residual gases is pre-accelerated. During further downward movement of the piston 20 the scavenging openings 4a, 4b and 5a, 5b are uncovered. Scavenging flows SB enter the cylinder from the pair of scavenging openings 4a, 4b and due to the smaller arrow-like shaped angle b the stream of scavenging medium has a greater forward speed relative to the scavenging flows SA, however, because of the smaller elevation angle e the upward flow has a flatter tendency. At the same time, the scavenging flows SC pass into the interior of the cylinder through the scavenging openings 5a, 5b and due to the smallest arrow-like shaped angle c, the scavenging flows SC have the greatest forward speed, but due to the smallest elevation angle f these flows have the flattest tendency, that is, they flow very closely over the surface of the piston 20. The symmetrically arranged scavenging flows SA, SB and SC build upon one another when they meet and form interengaging scavenging curtains extending transversely across the cylinder volume.

Due to the staggered action of the speeds and directions of the individual scavenging flows SA, SB and SC, a cleaning curtain, without any gaps and essentially laminar in character, is generated by the inflow of the scavenging medium and guarantees an optimum degree of scavenging. In other words, the fresh inflowing gas forms a kind of compact gas bubble which, increasingly enriched, as it expands in the cylinder, displaces the burned gases without essentially mixing with such gases. Preferably, this gas bubble is pushed back into the cylinder volume by the high-pressure wave acting at the exhaust opening. Accordingly, the fresh gas is not deflected toward the exhaust in the form of individual gas flows over the cylinder head as is the case in conventional scavenging systems.

While specific embodiments of the invention have been shown and described in detail to illustrate the application of the inventive principles, it will be understood that the invention may be embodied otherwise without departing from such principles.

What is claimed is:

1. Two-stroke internal combustion piston engine comprising a pair of axially elongated cylinders disposed in axial alignment and spaced axially apart, a separate piston reciprocally movable in each said cylinder in the axial direction thereof and having a bottom dead center position within said cylinder, a separate piston rod connected to each said piston and said piston rods disposed in axial alignment, a rotating crank guide assembly located between said cylinders and coupling said piston rods for reciprocating said piston rods in the axial direction of said cylinders, said cylinders each including a cylinder wall extending in the axial direction of said cylinder defining the axially extending inner surface thereof, each said cylinder having an axially extending plane symmetrically dividing the interior of said cylinder, each said cylinder wall having an exhaust opening from the interior of said cylinder located in the region adjacent the bottom dead center position so that said exhaust opening is open when said piston is in the bottom dead center position, said exhaust opening being symmetrically arranged relative to the axially extending plane in said cylinder and extending in the axial direction of said cylinder, each said cylinder wall having a plurality of scavenging openings therethrough opening into the interior of said cylinder, said scavenging openings being arranged in a number of pairs with each pair being symmetrically arranged relative to the axially extending plane so that each scavenging opening of one pair is located on an opposite side of the axially extending plane from the other said scavenging opening thereof, the axial extent of said scavenging openings are located in the axially extending region of said exhaust opening, said scavenging openings are spaced angularly from said exhaust opening relative to the axial direction of said cylinders, duct means for supplying the scavenging medium to said scavenging openings, said scavenging openings having first side surfaces extending in the axial direction of said cylinder and second side surfaces extending transversely of the axial direction of said cylinder, a first pair of said scavenging openings being located more remote from said exhaust opening than the other said scavenging openings, a second pair of said scavenging openings being located closer to said exhaust opening than the other said scavenging openings, the projection of said first side surfaces of said pairs of scavenging openings opening into the interior of said cylinder each intersect in an arrow-like shape with the point at the intersection directed away from said exhaust opening, the projections of said first side surfaces of said first pair of said scavenging openings forming an angle on the sides of said projections closer to said exhaust opening greater than the angle formed by said first side surfaces of the remaining pairs of said scavenging openings, with the arrow-like shaped angles formed thereby decreasing as said pairs of scavenging openings are located closer to said exhaust opening, and the projection of said second side surfaces of said pairs of scavenging openings extending into the interior of said cylinder forming an acute angle with a plane extending perpendicular to the axial direction of said cylinder and the acute angle formed by said first pair of scavenging openings being greater than the acute angle formed by said second side surfaces of the remaining said pairs of scavening openings with the acute angle formed thereby decreasing as said pairs of scavenging openings are located closer to said exhaust opening, so that the individually directed flows from the differently directed pairs of said scavenging openings build upon one another and initially flow away from said piston in the bottom dead center position to the opposite end of said cylinder and then reverse direction at the opposite end of said cylinder and flow toward said piston for displacing residual gases of the preceding working stroke out of said exhaust opening.

2. Two-stroke internal combustion piston engine, as set forth in claim 1, wherein the projections of the axially extending side surfaces of said first pair of said scavenging openings intersect and form an angle of about 160° on the side of said projections closer to said exhaust opening and said transversely extending side surfaces of said first pair of scavenging openings forming an acute angle of about 25° with the plane extending perpendicularly of the axis of said cylinder, said projections of said axially extending side surfaces of said second pair of scavenging openings intersect and form an angle of about 110° on the side of said projections closer to the exhaust opening and said transversely extending side surfaces of said second pair of said scavenging opens form an acute angle of about 10° with the plane extending perpendicularly of the axis of said cylinder, and a third pair of said scavenging openings located between said first pair and said second pair with the projections of the axially extending side surfaces of said third pair of scavenging openings forming an angle of about 140° on the sides of said projections closer to said exhaust opening and said transversely extending side surfaces of said third pair of said scavenging openings form an acute angle of about 15° with the plane extending perpendicularly of the axial direction of said cylinder.

3. Two-stroke internal combustion piston engine, as set forth in claim 1 or 2 wherein each of said scavenging openings having one transversely extending side surface more remote from said piston in the bottom dead center position thereof than the other transversely extending side surface and said more remotely arranged transversely extending side surfaces of said first pair of said scavenging openings being located further from the bottom dead center position of said piston than the corresponding transversely extending side surfaces of the remaining said scavenging openings.

4. Two-stroke internal combustion piston engine, as set forth in claim 1 or 2, including a separating wall extending transversely across the end of each said cylinder adjacent said crank guide assembly and separating the cylinder from said crank guide assembly, and said separating walls serving as bearings for said piston rods.

5. Two-stroke internal combustion piston engine, as set forth in claim 4, wherein said separating walls each forming a bearing hub in the central portion thereof for supporting said piston rod extending therethrough.

6. Two-stroke internal combustion piston engine, as set forth in claim 5, wherein said bearing hubs extend in the axial direction of said cylinder from said separating wall toward the associated said cylinder and said bearing hubs having a conically shaped surface converging in the direction of the associated said cylinder and the conically shaped surface of said bearing hubs corresponding to the adjacent surface of said piston and the arrangement of the surface of said bearing hubs being selected in dependence on the respectively selected number and position of said duct means for supplying the scavenging medium.

7. Two-stroke internal combustion piston engine, as set forth in claim 4, wherein said duct means having inlets in said cylinder wall at the opposite end thereof from the bottom dead center position with the inlets being flush with the surface of said separating walls facing into said cylinder.

* * * * *